US008789694B2

(12) United States Patent
Roesler

(10) Patent No.: US 8,789,694 B2
(45) Date of Patent: Jul. 29, 2014

(54) PACKAGING CONTAINER OF VARIABLE LENGTH

(75) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 11 days.

(21) Appl. No.: 13/598,853

(22) Filed: Aug. 30, 2012

(65) Prior Publication Data

US 2013/0062234 A1 Mar. 14, 2013

(30) Foreign Application Priority Data

Sep. 12, 2011 (DE) ..... 20 2011 105 567 U

(51) Int. Cl.
*B65D 6/00* (2006.01)

(52) U.S. Cl.
USPC ..... 206/349; 206/1.5; 220/8; 220/4.21; 220/4.06

(58) Field of Classification Search
USPC ..... 206/1.5, 349; 220/8, 4.21, 4.01, 4.04, 220/4.06, 4.24; 24/455
See application file for complete search history.

(56) References Cited

U.S. PATENT DOCUMENTS

| | | | | | |
|---|---|---|---|---|---|
| 1,450,674 | A | * | 4/1923 | Marston | 220/8 |
| 3,521,810 | A | * | 7/1970 | Boyer | 229/101 |
| 4,509,656 | A | * | 4/1985 | Rosler | 220/8 |
| 5,605,242 | A | * | 2/1997 | Hwang | 220/8 |
| 5,680,949 | A | * | 10/1997 | Roesler | 220/8 |
| 5,829,591 | A | * | 11/1998 | Lyons | 206/373 |
| D574,605 | S | * | 8/2008 | Schroeder et al. | D3/201 |

FOREIGN PATENT DOCUMENTS

| | | |
|---|---|---|
| DE | 7620793 | 10/1976 |
| DE | 3325033 | 3/1984 |
| EP | 1087083 | 3/2001 |

* cited by examiner

*Primary Examiner* — Steven A. Reynolds
*Assistant Examiner* — Javier A Pagan
(74) *Attorney, Agent, or Firm* — Cohen & Grigsby, PC

(57) ABSTRACT

A packaging container (1) wherein an inner body (6) slides telescopically within an outer body (7). A locking element (12) is fitted to the outer body (7) and secures the position of inner body (6) with respect the outer body (7). Locking element (12) includes spring tabs (10) with radial hooks (16) that engage detent elements (8) on inner body (6) at times when a fastener (14) on locking element (12) is closed. Locking element (12) is composed of sections (12*a*-12*d*) such that the locking element can be laid open and inner body (6) can be withdrawn from outer body (7).

32 Claims, 6 Drawing Sheets

PACKAGING CONTAINER OF VARIABLE LENGTH

BACKGROUND OF THE INVENTION

1. Field of the Invention

The present invention relates to a packaging container of variable length for long objects, in particular for heavy tools. The disclosed packaging container includes two cylinder-shaped or tubular-shaped hollow bodies (6, 7) each closed at one end (2, 3). The two hollow bodies are capable of being telescopically pushed together and pulled apart by means of a sliding movement (4) along their aligned longitudinal axis (5). The container has at least one longitudinal row of detent elements (8) that extend substantially over the entire length of the outer casing (11) of the inner hollow body (6), and at least one counter detent element (10) that is mounted in the area of the open end (9) on the hollow body (7). The counter detent engages the at least one longitudinal row of detent elements (8).

2. Discussion of the Prior Art

Numerous packaging containers of variable length of the aforementioned kind are known in the prior art.

For example, German patent publication DE 7620793 U1 discloses a packaging container for elongated objects, which is comprised of two cylindrically shaped hollow bodies, each closed at one end and connected to one another by a sliding movement along their longitudinal axis, and which has at least one detent arrangement extending substantially over the entire length thereof, and a counterpart attached in the area of the open end on the second hollow body and cooperating with the detent arrangement, wherein the detent arrangement is attached to the outer surface of the inner hollow body with teeth that face outwardly, in particular at right angles in longitudinal profile, and the counterpart that engages the teeth is a ring-like indentation that encircles the hollow body proximate the open end thereof. This indentation is provided with surfaces that converge from the end face in the direction of the longitudinal axis thereof and which end at an annular surface that protrudes at a virtual right angle to the casing of the hollow body and in the direction of the longitudinal axis of the hollow body. In this configuration, the closed end surfaces of both hollow bodies have a triangular or multi-angular contour.

German patent publication DE 3325033 C2 also discloses a packaging container of variable length, a packaging container for preferably elongated objects comprised of two hollow bodies, each closed at one end and open at the opposite end and connected to another by a sliding movement along the longitudinal axis, and which has a row of elevations attached to the outer surface of the inner hollow body and extending over the greater portion of its length in a direction parallel to its longitudinal axis which protrude above the outer surface, and further a counterpart in the area of the open curvature of the hollow body formed by an indentation that engages the elevations in the form of a detent arrangement, wherein both hollow bodies have a square cross-section with rounded corners, and formed on at least two corners of the inner hollow body located diagonally opposite one another are elevations spaced apart from one another, each in the same plane perpendicular to the longitudinal axis of the hollow body, and on each corner of the hollow body proximate the open end thereof at least one inwardly projecting rib is arranged between two abutting walls, and the outer radius of the curvature of the corner of the inner hollow body is greater than the inner radius of the curvature of the corner of the hollow body. The at least one inwardly projecting rib of the hollow body has in the middle portion of its extension a rounded recess and is provided with a bevel in the direction of the closed end of the hollow body which transitions into a horizontal or nearly horizontal surface that faces the closed end of the hollow body. The elevations are in the form of nubs that have an oval or circular base.

The disadvantage of the aforementioned prior art packing containers of variable length is that when heavy objects are being accommodated in particularly large packing containers, it is not possible to appropriately set the separating force of the snap-lock mechanism between the two hollow bodies. If the separating force is too small, there is the risk of the contained object falling out and thus the risk of damage to the object and to the environment, as well as the risk of injury to the user and any persons nearby. If the separating force is too great, there is the risk that the container can then no longer be opened or only by exerting extreme pulling forces while running the risk of damage to the container, of the object contained therein or of the environment, in addition to the risk of injury to the user and to any persons nearby.

SUMMARY OF THE INVENTION

It is therefore the object of the present invention to further develop a cost effective packaging container of variable length of the aforementioned kind in such a way that even when accommodating heavy objects the former remains securely locked, but can nevertheless be easily, quickly and safely opened and closed at will and with minimum effort.

The object is achieved by the presently disclosed invention.

Preferably, at least one counter detent element for the outer hollow body is disposed on a separate locking element attached at the open end of the outer hollow body on its outer casing. With the locking element in locked position at least one of the detent elements thereof permits relative movement of both hollow bodies in the push-together direction but locks them in place in the pull-apart direction. With the locking element in the unlocked position the detent element permits movement in both the push-together and the pull-apart directions.

More preferably, the detent elements for the outer hollow body are arranged on a separate ring-shaped locking band which is releasably attached on the outer casing of the outer hollow body at the open end thereof. When the ring-shaped locking band is closed, the detent elements on the locking band permit in a locking fashion movement of both hollow bodies relative to one another in the push-together direction, but lock them in place in the pull-apart direction. With the ring-shaped locking band opened, they permit relative movement in both the push-together and pull-apart directions.

Among other differences, the disclosed longitudinally adjustable packaging is distinguished by the presence of a collar at the open portion of and encircling the one container segment, on the inside of which is a nub structure that interacts with the nub structure of the opposite container segment.

The detent elements for the outer hollow body are disposed on the inner casing of the outer hollow body and a separate ring-shaped locking band is releasably attached on the outer casing of the outer hollow body at the open end thereof. When the locking band is closed, the detent elements permit movement of both hollow bodies relative to one another in the push-together direction, and locks them in place in the pull-apart direction. With the ring-shaped locking band opened, they permit relative movement in both the push-together and pull-apart directions.

Accordingly, heavy objects are better retained in the package and it is possible to easily and quickly longitudinally adjust the package in the push-together direction, especially after the package has been filled.

Still more preferably, the ring-shaped locking band is provided at least one location with a fastener, by means of which the locking band can be switched from a locked to an unlocked position. With the locking band in the locked position, it is in the form of a locked ring. With the locking band in the unlocked position, it no longer constitutes a closed ring, but is rather an open band with two free ends.

This fastener on the locking band is designed in particular as a snap-lock fastener, but could also be a knee lever or hook-and-loop fastener or the like.

The detent elements on the locking band are advantageously spring tabs formed by material bonding with the casing of the locking band and clamped on one side (in particular clamped on the side of the inner hollow body), in which a radial hook is materially bonded at the free ends of the spring tabs which lockingly engages the grooves or elevations of the inner hollow body. These hooks have an inclined plane in the push-on direction to allow both hollow bodies to be easily pushed together, and they have a radially extending edge in the pull-apart direction to achieve positive form-locking and to prevent the hollow bodies from being pulled apart. If the locking band is opened, the radial hooks then become disengaged from the grooves or elevations of the inner hollow body, thus allowing both hollow bodies to be pulled apart without resistance and the object contained therein to be removed.

The locking band for a packaging container having a square or rectangular cross-section is divided into four sections that are linked to one another by three hinges (film or foil hinges where plastic material is used) and are connectable with one another for repeated release at the free end of the snap-lock fastener. Preferably, then, spring tabs are arranged on the locking band in the area of each corner of the hollow body, thus a total of 8 pieces, though it is possible to omit one spring tab in the area of the fastener, as well as the spring tabs on the part of the locking band located opposite the fold away part of the locking band, thereby leaving only 4 or 5 spring tabs. However, only one functional spring tab is necessary, whereby 2 diametrically opposed spring tabs prevent the locking band from tilting and thereby becoming loose.

For better securing of the locking band on the outer casing of the hollow body, a detent assembly is provided between these which prevents the closed locking band from being axially removed from the hollow body. In particular, the outer hollow body has at least one circumferential groove which can be axially securely engaged by at least one circumferential rib on the inner casing of the locking band. However, multiple circumferential grooves or ribs axially arranged one behind the other and/or circumferentially spaced apart may also be included.

To guide the inner hollow body axially within the hollow body, projections offset radially inwardly are provided on the inner casing, located in particular in the corners/longitudinal edges of the square or rectangular packaging container. Provision can be made for one projection or multiple axially spaced apart projections per longitudinal edge. These projections are preferably material-bonded beads formed from the wall material of the hollow body and are seen from the outside as "inverted beads".

Preferably, all the components of the packaging container according to the present invention are made of plastic, both hollow bodies being produced in a plastic hollow blasting process, with the locking band produced as a plastic injection-molded part.

The cross-section of the packaging container of the present invention may be of any shape, that is, circular, elliptical, oval, polygonal, in particular square.

The present invention is discussed in greater detail below with reference to drawings for a mode of execution.

DESCRIPTION OF A PRESENTLY PREFERRED EMBODIMENT

Figure 1:
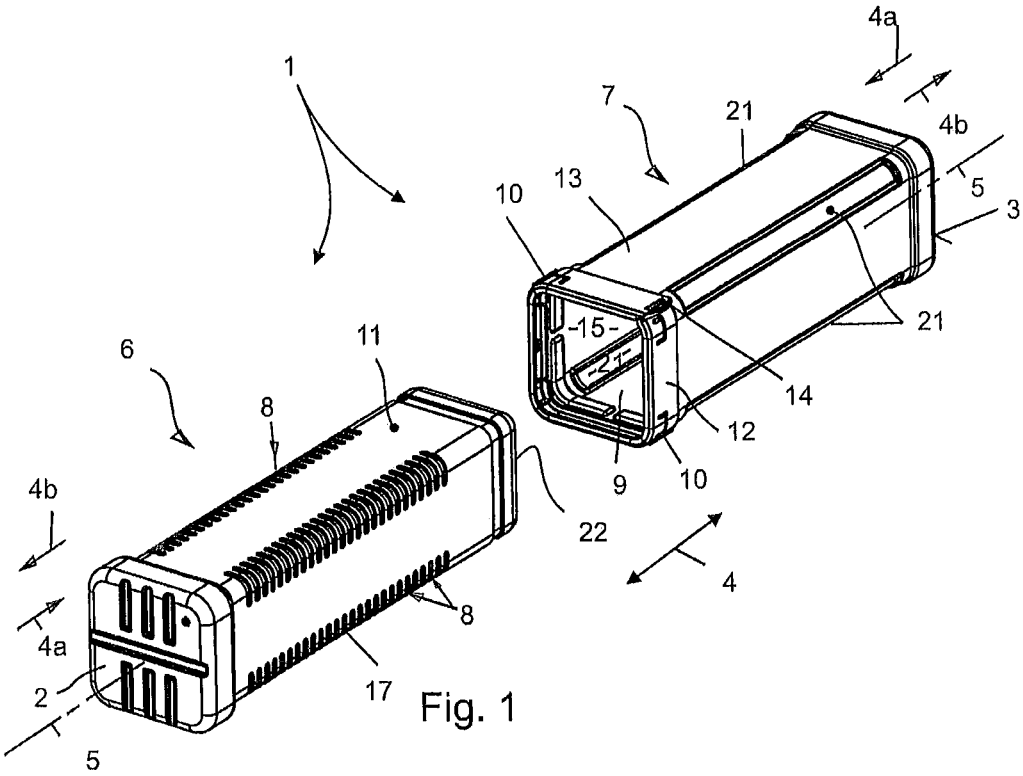
FIG. 1 is a perspective view of a preferred embodiment of the packaging container with the inner hollow body separated from the outer hollow body.

As seen in FIGS. 1 and 6-8, the packaging container 1 according to the present invention consists of three parts, namely, a tubular-shaped inner hollow body 6, a tubular-shaped outer hollow body 7 and a separate locking element 12 which secures the former. Inner hollow body 6 is defined between outer surface or casing 11 and inner surface or casing 11*a*. Outer hollow body 7 is defined between outer surface or casing 13 and inner surface of casing 15. In this assembly both hollow bodies 6, 7 are square in cross-section and extend cylindrically along their entire longitudinal axis 5, each of said bodies having a closed end 2,3 and an open end 9, 22.

Once the inner hollow body 6 is inserted into the hollow body 7, both hollow bodies 6, 7 can be moved longitudinally in a telescopic manner relative to one another in the directions of movement 4. When the packaging container 1 is intended to be smaller, both hollow bodies 6,7 are simply telescoped into one another in the push-together direction 4*a*; when the packaging container is intended to be larger, the locking element 12 is opened or unlocked and both hollow bodies 6, 7 are simply drawn apart in the pull-apart direction 4*b*.

Provision is made for a longitudinal row of detent elements 8 with detent grooves 17 on each of the edges of the outer surface or outer casing 11 of the inner hollow body 6, wherein the detent grooves 17 extend arc-like around the longitudinal edge and are present on both adjacent surfaces of the casing 11. The four longitudinal rows of detent elements 8 are configured in such a way that the respective detent grooves 17 correspond to one another, that is, they are present in the same longitudinal spacing along the longitudinal axis 5, such that the spacing between the detent grooves 17 is also the same. Of course, the detent grooves 17 could also extend continuously around the casing 11, but this is functionally unnecessary. Sufficient for this purpose is a single row of detent elements 8 with detent grooves 17 which lockingly engage the counter detent elements 10 on the locking band 12.

The locking element 12 is attached to the outer surface or outer casing 13 of the hollow body by being placed as a sleeve or collar on the open end 9 and closed in the form of a ring band by means of a fastener 14.

Figure 2:
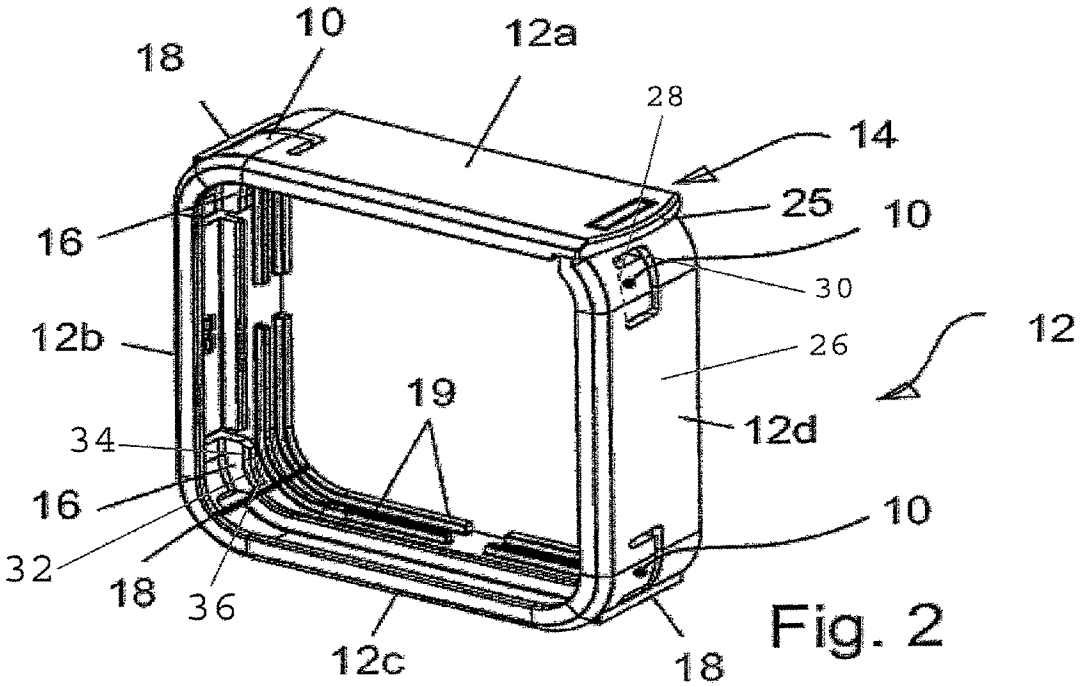
FIG. 2 is a perspective view of the locking element.
Figure 4:
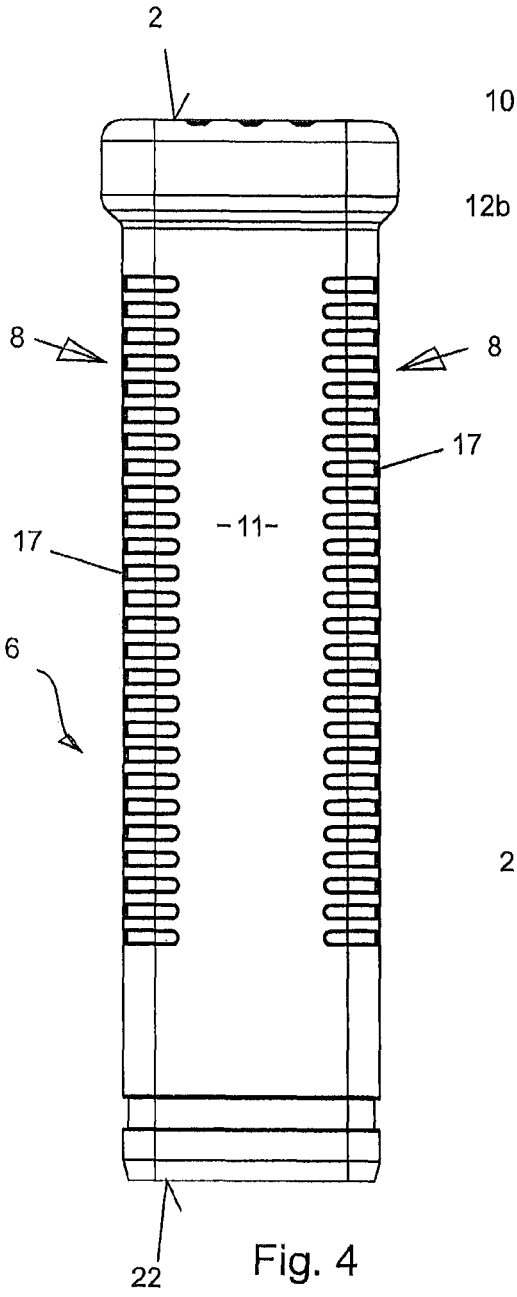
FIG. 4 is a longitudinal view of the inner hollow body.
Figure 3:
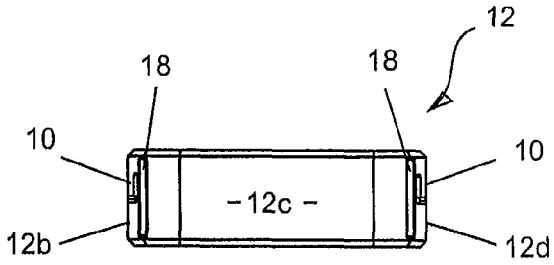
FIG. 3 is a bottom view of FIG. 2.
Figure 5:
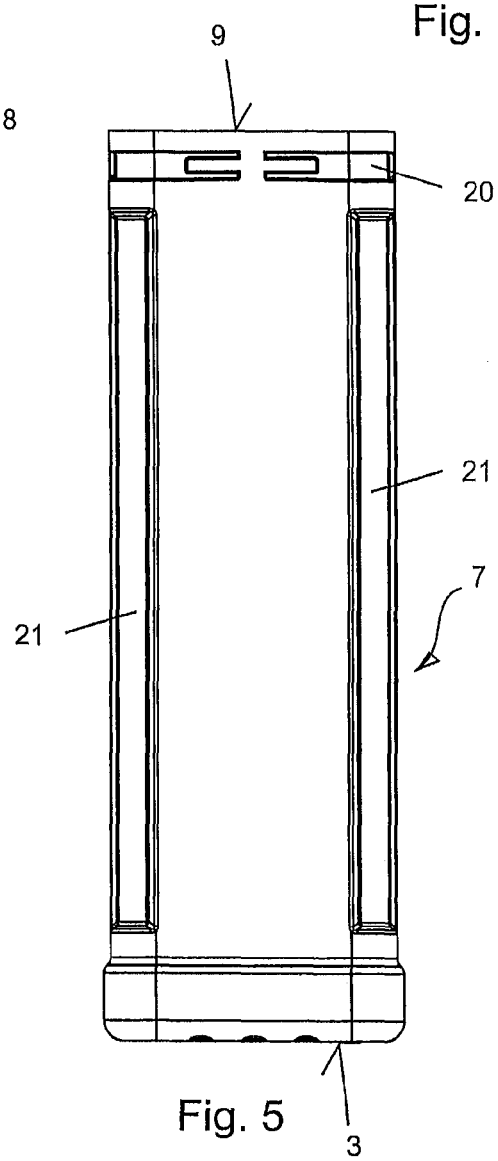
FIG. 5 is a longitudinal view of the outer hollow body.
Figure 6:
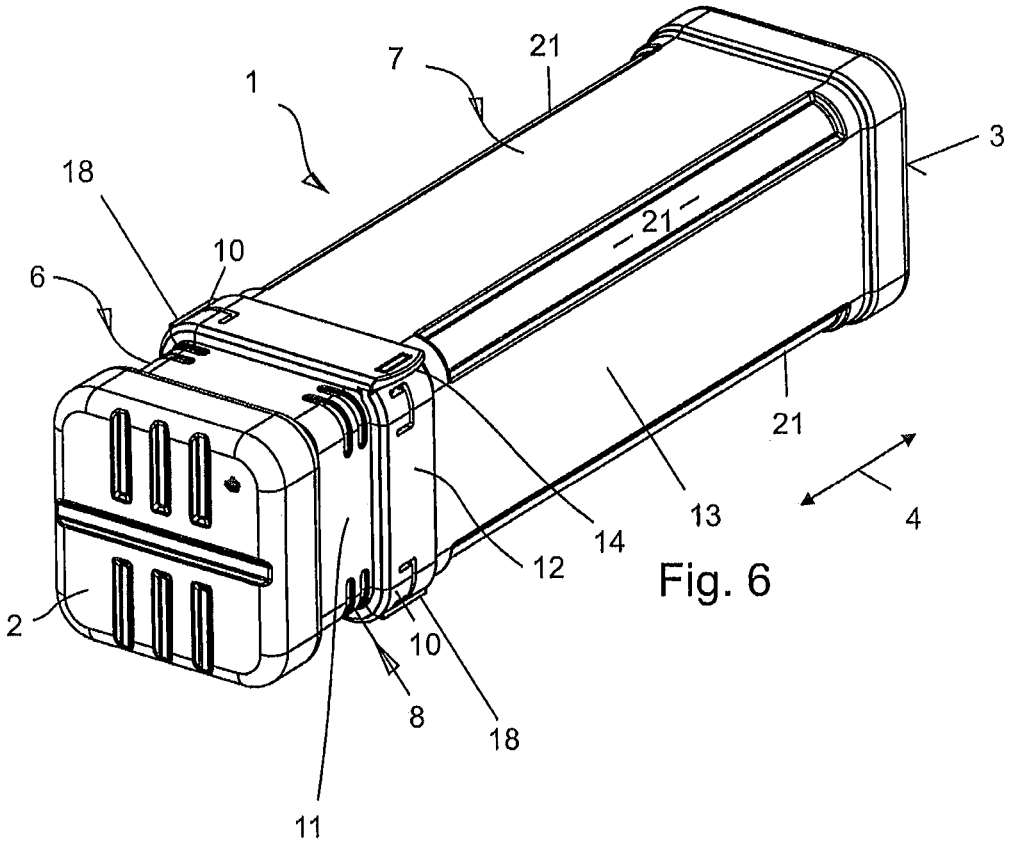
FIG. 6 is a perspective view of the packaging container shown in FIG. 1 in the nearly completely telescoped position.
Figure 7:
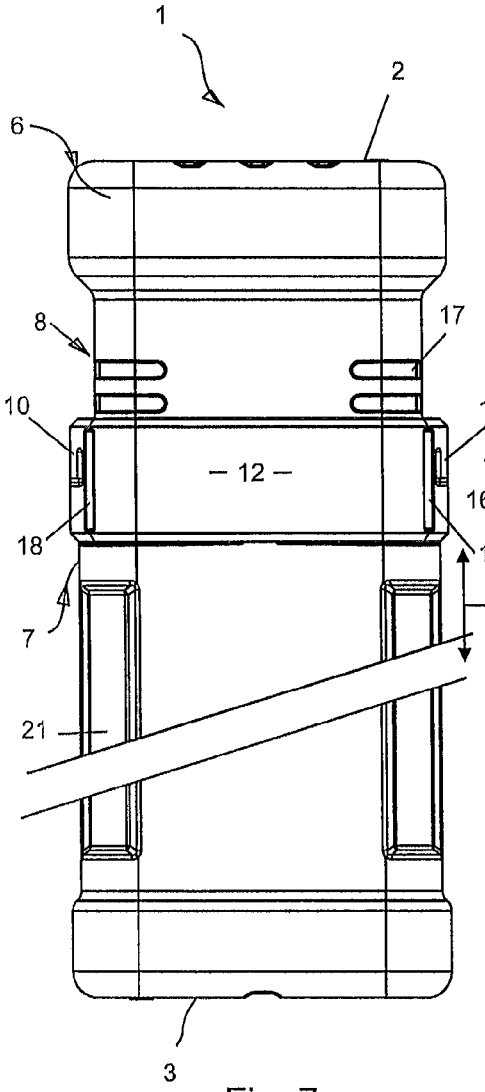
FIG. 7 is a longitudinal view of the packaging container.
Figure 8:
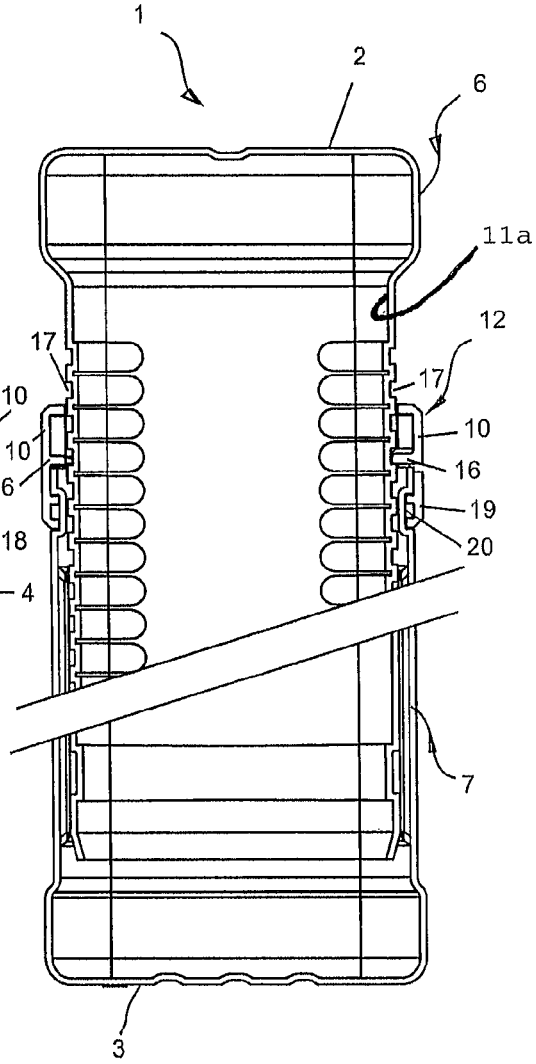
FIG. 8 is a longitudinal section of the packaging container.

FIG. 2 shows an enlarged view of the locking element 12 with the locking element 12 in the closed or locked state. It consists of four sections of equal length 12*a*-12*d*, thereby forming a square ring. Three of the four sections of the locking element 14 are articulated by means of a foil hinge connection 18, such that they can be angled 90° to one another. A releasable and attachable connecting fastener 14 is provided between both sections 12*a* and 12*d*, designed in this case as a snap-locking connection.

Present in the corner areas of the locking element 12 are the spring tabs 10 with radial hooks 16, which are able to form-lockingly engage the grooves 17 of the row of detent elements 8 on the outer casing 11 of the inner hollow body 6. For reasons of space and stability, the spring tab 10 is omitted from the upper section 12*a* on the side of the fastener 14. The spring tabs 10 are omitted from the lower section 12*c* for the simple reason of being able to pull apart the entire packaging container when placing it flat on a table 24 with the heavy object contained therein.

Spring tab 10 is formed in casing 26 of the locking element 12. Spring tab 10 has a first side 28 that is integral with casing 26 and a second side 30 that is opposite from first side 28 and that is formed as radial hook 16 that engages the detent elements of the row of detent elements 8 on the second tubular-shaped hollow body 6 at times when the locking element 12 is in the closed position.

The radial hook 16 of spring tab 10 has a terminal edge 32 that is defined between first side 34 and second side 36. In the assembled packaging container, first side 34 of terminal edge 32 is closer to the closed end 2 of the second tubular-shaped hollow body 6 than the second side 36 of the terminal edge 32. Also, the first side 34 of terminal edge 32 is radially closer to the casing 26 of locking element 12 than the second side 36 of terminal edge 32 such that the terminal edge is a surface that is inclined with respect to the longitudinal axis 5 of the second tubular-shaped hollow body 6. Due to the inclined aspect of terminal edge 32, the terminal edge glides over the detent elements of the row of detent elements 8 of the second tubular-shaped hollow body 6 when the closed end 3 of the first tubular-shaped hollow body 7 is urged toward the closed end 2 of the second tubular-shaped hollow body 6.

The second side 36 of terminal edge 32 engages the detent elements of the row of detent elements 8 of the second tubular-shaped hollow body 6 when the closed end 3 of the first tubular-shaped hollow body 7 is urged away from the closed end 2 of the second tubular-shaped hollow body 6.

Figure 9:
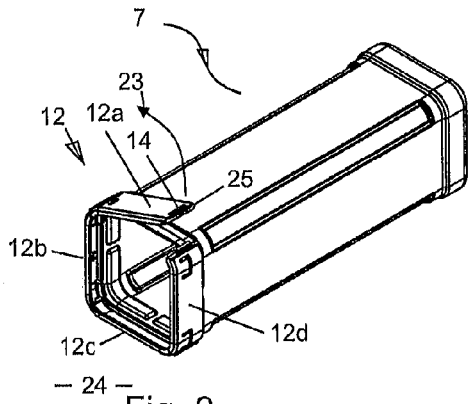
FIG. 9 is a perspective view of the outer hollow body with the locking element when the locking element is in a barely opened position.
Figure 10:
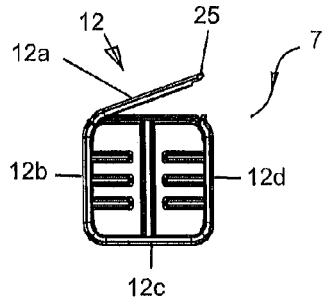
FIG. 10 is a view of the packaging container shown in FIG. 9, taken along the axial direction.
Figure 11:
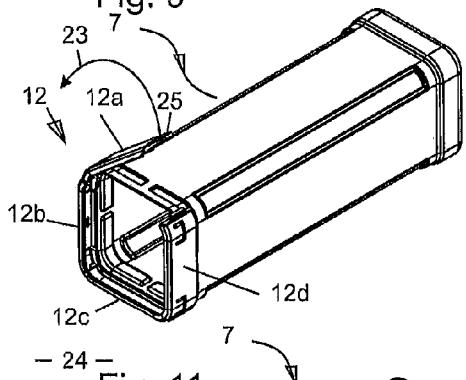
FIG. 11 is a perspective view of the outer hollow body with the locking element when the locking element is opened further than in FIG. 9.
Figure 12:
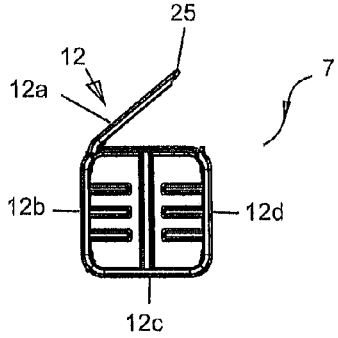
FIG. 12 is a view of the packaging container of FIG. 11, taken in the axial direction.
Figure 13:
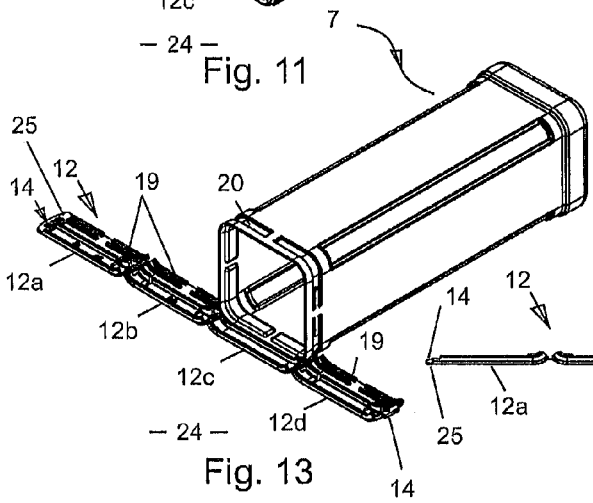
FIG. 13 is a perspective view of the outer hollow body with the locking element when the locking element is the completely opened position.
Figure 14:
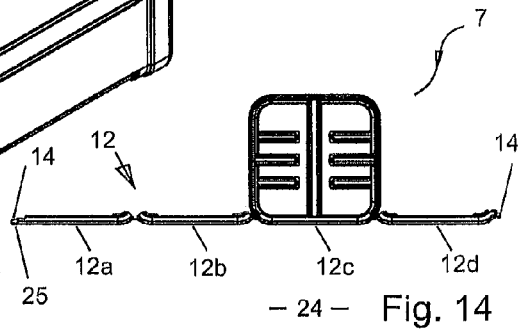
FIG. 14 is a view of the packaging container of FIG. 13, taken in the axial direction.

In this regard, reference is made to FIGS. 9-14 which illustrate in greater detail the sequence of steps for the sections 12*a*-12*d* of the locking element 12. First, the entire packaging container is placed on a table 24 so that the flap 12*a* is located on top. In FIGS. 9 and 10 the fastener 14 has been opened or unlocked by hand by pulling up on the upper flap 12 in the lifting direction 23, whereby the upper flap 12*a* automatically flips upward as a result of the internal tension of the film hinge 18 between the sections 12*a* and 12*b*. Then, the upper flap 12*a* is moved further by hand in the lifting direction 23 resulting in the position as seen in FIGS. 11 and 12. If the flap 12*a* is then folded over down onto the table 24, as with the end flap 12*d*, then one arrives at the position as seen in FIGS. 13 and 14 in which all the sections 12*a*-12*d* of the locking element 12 are laid out on the table 24. Since no spring tabs 10 are provided in the lower section 12*c*, it is only possible at this point for the inner hollow body 6 (not drawn in FIGS. 9-14) to be pulled out of the open end 9 of the hollow body 7 without this being prevented by the form-lockingly engagement of hooks 16 of the spring tabs 10. The omission of the lower spring tabs, in the lower flap 12*c*, is convenient, particularly when there are heavy objects in the container 1, and it offers improved safety against damage and injury.

Of course, it is also possible to omit the spring tabs 10 from flap 12*b* and/or 12*d* instead of from flap 12*c*, but then to open the container 1, the latter would have to be placed down on the table 24 with the flaps 12*b* or 12*d* facing downward. In any case, the flap 12*a* at least, which has a handle 25 used for gripping by a user when loosening the fastener 14, has at least one spring tab 10 since said flap 12*a* is never placed on the table 24 for opening the container 1.

It is also possible, however, to design all of the flaps 12*a*-12*d* with spring tabs 10, then at the position indicated in FIGS. 13 and 14 initially under the hollow body 7 to radially extract the locking element 12, after which the inner hollow body 6 can be readily extracted from the hollow body 7 in the axial direction 4*b* of the longitudinal axis 5.

Furthermore, provision may be made for spring tabs 10 not only in the edge/corner areas and associated grooves 17, but instead everywhere on the surface of the casing 11 or the flaps 12*a*-12*d*. Since, however, the edge/corner areas exhibit the greatest stability and as a result here a relatively precise and constant detent force can be defined, the latter are preferred as locations for spring tabs 10 and grooves 17.

Finally, in the case of objects that are very heavy to accommodate, the spring tabs 10 can be doubled or increased multiple times by providing two or more axial spring tabs 10 in succession in which the distance between each is the same as that of the grooves 17 of the longitudinal row of detent elements 8 in the casing 11 of the inner hollow body.

The locking element 12 can be attached to the outer casing 13 of the hollow body 7 by pure friction lock, however, a form lock by means of snap-lock engagement 19, 20 of groove and spring between these two components is preferable.

To enable the inner hollow body 6 to be suitably guided along the entire axial length of the hollow body 7, said hollow body 7 has on its inner surface or inner casing 15 radially inwardly directed projections in the form of beads, present either uninterrupted over nearly the entire length or in sections only where a plurality of shorter beads are provided. The radial depth of these beads corresponds roughly to the difference in dimension between the outer casing of the inner hollow body 6 and the remaining inner casing of the outer hollow body 7. These beads again are preferably provided in the corner/edge regions of the hollow body 7, since it is there that the container is most stable and thus it is there that the least amount of shape deviation is expected when in use.

DRAWING LEGENDS

1. Packaging container
2. End
3. End
4. Sliding movements; 4*a* direction of push; 4*b* direction of pull
5. Longitudinal axis of 1, 6 and 7
6. Inner hollow body
7. Outer hollow body

8. Longitudinal row of detent elements on 6
9. Open free end of 7
10. Counter detent elements or spring tabs
11. Outer casing of 6
12. Separate locking element; 12*a*-12*d* flaps of 12
13. Outer casing of 7
14. Fastener of 12
15. Inner casing of 7
16. Hooks of 10
17. Grooves of 8
18. Film or foil hinge
19. Snap-lock of 12 for 7
20. Snap-lock of 7 for 12
21. Radially inwardly directed projections in 13
22. Open free end of 6
23. Lifting direction of 12*a*
24. Table
25. Handle on 14.

What is claimed is:

1. A packaging container of variable length for long objects, in particular heavy tools, said packaging container comprising:

two cylinder-shaped hollow bodies, one of said hollow bodies being an inner hollow body with an outer casing and a longitudinal axis and the other of said hollow bodies being an outer hollow body with an inner casing and an outer casing and a longitudinal axis, each of said bodies being closed at one end and being open at the opposite end, said bodies being telescopically pushed together and pulled apart by a sliding movement along the longitudinal axis of said bodies;

at least one longitudinal row of detent elements that extend substantially over the outer casing of the inner hollow body, and at least one counter detent element that is mounted adjacent the open end of the outer hollow body and that engages the at least one longitudinal row of detent elements, said at least one counter detent element being located on a separate locking element that is releasably attached to the outer casing of the outer hollow body at the open end thereof such that the locking element can be separated from the outer hollow body, when at least one of the counter detents is in the locked position with a detent element, said locking element permitting relative movement of the inner and outer hollow bodies in the push-together direction, but lockingly engaging the inner and outer hollow bodies in the pull-apart direction, and when the counter detents are in the unlocked position, the locking element permitting relative movement of the inner and outer hollow bodies in the push-together direction and in the pull-apart direction.

2. The packaging container according to claim 1 wherein the separate locking element is ring-shaped and can be repeatedly opened and closed by at least one fastener, whereby, when the at least one fastener is opened, the locking element forms an open chain with at least the one counter detent element disengaged from the detent elements of the inner hollow body.

3. The packaging container of claim 2 wherein the fastener of the locking element is selected from the group comprising a snap-lock fastener, a knee lever fastener, and a hook-and-loop fastener.

4. The packaging container of claim 2 wherein said locking element has a casing and wherein said at least one row of detent elements on the inner hollow body is a series of grooves or a series of elevations, and wherein said counter-detent element is a spring tab that is formed in said casing of the locking element, said spring tab being clamped on one side and having a free end on the opposite side; said free end of the spring tab being formed with a radial hook that lockingly engages grooves or elevations of the inner hollow body when the locking element is in the locked state.

5. The packaging container of claim 4 wherein the radial hook contacts the detent elements on the inner hollow body with an inclined plane when the inner and outer hollow bodies are urged together and contacts the detent elements on the inner hollow body with a radially extending edge when in the inner and outer hollow bodies are urged apart.

6. The packaging container according to claim 2 wherein the packaging container has a four-sided cross-section, said locking element being divided into four sections that are linked to one another by three hinges of plastic material, said fastener selectively connecting the two free ends of the locking element sections in a locked state and an unlocked state.

7. The packaging container of claim 2 wherein a detent assembly is also provided between the locking element and the outer hollow body to form-lockingly secure the locking element on the outer casing of the outer hollow body and prevent the locking element from being axially removed from the outer hollow body when the locking element is in the locked state.

8. The packaging container of claim 6 wherein projections that are offset radially inwardly are provided in the corners of the inner casing of the outer hollow body to guide the inner hollow body axially within the outer hollow body.

9. A packaging container of variable length for long objects, in particular heavy tools, said packaging container comprising:

two cylinder-shaped hollow bodies, one of said hollow bodies being an inner hollow body with an outer casing and a longitudinal axis and the other of said hollow bodies being an outer hollow body with an inner casing and an outer casing and a longitudinal axis, each of said bodies being closed at one end and being open at the opposite end, said bodies being capable of being telescopically pushed together and pulled apart by means of a sliding movement along the longitudinal axis of said bodies;

at least one longitudinal row of detent elements that extend substantially over the outer casing of the inner hollow body, and at least one counter-detent element that is mounted in the area of the open end of the outer hollow body and that engages the at least one longitudinal row of detent elements, said at least one counter detent element being located on the inner casing of the outer hollow body, wherein a separate ring-shaped locking band that can be selectively opened and closed, is mounted on the outer casing of the outer hollow body at the open end thereof, when the locking band is in the closed position the counter-detent element form-lockingly engages a detent element of the longitudinal row of detent elements to block the relative movement of the inner and outer hollow bodies in the push-together direction and in the pull-apart direction, but when the locking band is in the open position the counter-detent element permits relative movement of the inner and outer hollow bodies in the push-together direction and in the pull-apart direction.

10. The packaging container according to claim 9 wherein the separate locking band is releasably attached to the outer casing of the outer hollow body such that the locking band can be separated from the outer hollow body.

11. The packaging container according to claim 10 wherein the separate locking band is ring-shaped and can be repeatedly opened and closed by at least one fastener, whereby, when the at least one fastener is opened, the locking band forms an open chain with at least the one counter-detent element disengaged from the detent elements of the inner hollow body.

12. The packaging container of claim 11 wherein the fastener of the locking band is selected from the group comprising a snap-lock fastener, a knee lever fastener, and a hook-and-loop fastener.

13. The packaging container of claim 11 wherein said locking band has a casing and wherein said at least one row of detent elements on the inner hollow body is a series of grooves or a series of elevations, and wherein said counter-detent element is a spring tab that is formed in said casing of the locking band, said spring tab being clamped on one side and having a free end on the opposite side, said free end of the spring tab being formed with a radial hook lockingly engages grooves or elevations of the inner hollow body when the locking band is in the locked state.

14. The packaging container according to claim 11 wherein the packaging container has a four-sided cross-section, said locking band being divided into four sections that are linked to one another by three hinges of plastic material, said fastener selectively connecting the two free ends of the locking band sections in a locked state and in an unlocked state.

15. The packaging container of claim 11 wherein a detent assembly is also provided between the locking band and the outer hollow body to form-lockingly secure the locking band on the outer easing of the outer hollow body and prevent the locking band from being axially removed from the outer hollow body when the locking band is in the locked state.

16. The packaging container of claim 14 wherein projections that are offset radially inwardly are provided in the corners of the inner casing of the outer hollow body to guide the inner hollow body axially within the outer hollow body.

17. A variable length packaging container comprising:

a first tubular-shaped hollow body that is defined along a longitudinal axis by an outer surface and an inner surface, said first tubular-shaped hollow body being closed at one end and being open at the opposite end;

a second tubular-shaped hollow body that is defined along a longitudinal axis by an outer surface and an inner surface, said second tubular-shaped hollow body being closed at one end and being open at the opposite end, said second tubular-shaped body having a smaller cross-section than the cross-section of said first tubular-shaped hollow body such that said second tubular-shaped hollow body fits within the open end of said first tubular-shaped hollow body so as to slidingly engage said first tubular-shaped hollow body in a longitudinal direction, the outer surface of said second tubular-shaped hollow body having at least one row of detent elements that extend outwardly from said outer surface, said row of detent elements being oriented in the longitudinal direction along said outer surface; and a locking element that has open and closed positions wherein said locking element has one of a male detent element and a female detent element and wherein said first tubular-shaped hollow body has the other of said male detent element and said female detent element such that, at times when said locking element is in the open position, said male detent element and said female detent element can be separated and said locking element is removable from said first tubular-shaped hollow body, said locking element engaging said first tubular-shaped hollow body adjacent the open end of said first tubular-shaped hollow body such that, at times when said locking element is closed, the longitudinal position of said locking element on said first tubular-shaped hollow body is fixed, said locking element having a closed position in which at least one counter-detent element of said locking element engages at least one of the detent elements of said at least one row of detent elements that extend outwardly from the outer surface of the second tubular-shaped hollow body such that said counter-detent element is movable in a longitudinal direction and in a first sense across said detent elements in said row of detent elements and is not movable in the opposite sense across said detent elements in said row of detent elements, said locking element also having an open position in which no counter-detent element of said locking element engages any detent element of said at least one row of detent elements such that;

at times when the locking element is in said closed position, the second tubular-shaped hollow body is moveable in a direction longitudinally into the first tubular-shaped hollow body when the closed end of the first tubular-shaped hollow body is urged toward the closed end of the second tubular-shaped hollow body, but the second tubular-shaped hollow body is not movable longitudinally out of the first tubular-shaped longitudinal body when the closed end of the first tubular-shaped hollow body is urged away from the closed end of the second tubular-shaped hollow body; and at times when the locking element is in said open position, the second tubular-shaped hollow body is moveable in a direction longitudinally into the first tubular-shaped hollow body and is also moveable in a direction longitudinally out of the first tubular-shaped hollow body.

18. The variable length packing container of claim 17, wherein said locking element engages said first tubular-shaped hollow body by closing against the outer surface of said first tubular-shaped hollow body, said locking element having a fastener for selectively opening and closing said locking element, said locking element being movable away from the outer surface of said first tubular-shaped hollow body at times when said fastener is in the open position to disengage the counter-detent of the locking element from the detent elements of said at least one row of detent elements.

19. The variable length packing container of claim 18 wherein the fastener of the locking element is selected from the group comprising a snap-lock fastener, a knee lever fastener, and a hook and loop fastener.

20. The variable length packing container of claim 18 wherein said locking element includes a casing and wherein said counter-detent of the locking element is a spring tab that is formed in said casing, said spring tab having a first side that is integral with said casing, said spring tab having a second side that is opposite from said first side and that is formed in a radial hook, said radial hook engaging the detent elements of said row of detent elements of said second tubular-shaped hollow body at times when the locking element is in the closed position.

21. The variable length packing container of claim 20 wherein the radial hook of said spring tab has a terminal edge that is defined between first and second sides, the first side of said terminal edge being closer to the closed end of said second tubular-shaped hollow body than the second side of said terminal edge and the first side of said terminal edge being radially closer to the casing of the locking element than the second side of said terminal edge such that said terminal edge is inclined with respect to the longitudinal axis of said second tubular-shaped hollow body and glides over the detent elements of said row of detent elements of said second tubular-shaped hollow body when the closed end of said first tubular-shaped hollow body is urged toward the closed end of said second tubular-shaped hollow body.

22. The variable length packing container of claim 21 wherein said second side of said terminal edge engages the detent elements of said row of detent elements of said second tubular-shaped hollow body when the closed end of said first tubular-shaped hollow body is urged away from the closed end of said second tubular-shaped hollow body.

23. The variable length packing container of claim 20 wherein the first and second tubular-shaped hollow bodies have a cross-section with four sides, said casing comprising four sections that are joined together in end-to-end relationship by three hinges, with each of said hinges being connected to the ends of two of said sections, the ends of two of said sections of said casing being connected to said fastener and selectively connected together by said fastener at times when said fastener is in the closed position.

24. The variable length packing container of claim 20 wherein the locking element has a detent structure and the first tubular-shaped hollow body has a counter-detent structure that is complementary to the detent structure of the locking element and that cooperates with the detent structure of the locking element to secure the locking element at a fixed longitudinal position on said first tubular-shaped hollow body.

25. The variable length packing container of claim 18 wherein the inner surface of said first tubular-shaped hollow body has radially inwardly extending projections at the corners of said inner surface to guide the second tubular-shaped hollow body in the longitudinal direction within said first tubular-shaped hollow body.

26. A variable length packaging container comprising:

a first tubular-shaped hollow body that is defined along a longitudinal axis by an outer surface and an inner surface, said first tubular-shaped hollow body being closed at one longitudinal end and being open at the opposite longitudinal end;

a second tubular-shaped hollow body that is defined along a longitudinal axis by an outer surface and an inner surface, said second tubular-shaped hollow body being closed at one longitudinal end and being open at the opposite longitudinal end, said second tubular-shaped body having a smaller cross-section than the cross-section of said first tubular-shaped hollow body such that the open end of said second tubular-shaped hollow body fits within the open end of said first tubular-shaped hollow body and the second tubular-shaped hollow body slidingly engages said first tubular-shaped hollow body in a longitudinal direction, the outer surface of said second tubular-shaped hollow body having at least one row of detent elements that extend outwardly from said outer surface, said row of detent elements being oriented in the longitudinal direction along said outer surface; and a locking element that engages said first tubular-shaped hollow body adjacent the open end of said first tubular-shaped hollow body such that the longitudinal position of said locking element on said first tubular-shaped hollow body is fixed, said locking element having one of a male detent element and a female detent element and said first tubular-shaped hollow body having the other of said male detent element and said female detent element such that, at times when said locking element is in the open position, said male detent element and said female detent element can be separated and said locking element is removable from said first tubular-shaped hollow body, said locking element having a closed position in which at least one counter-detent element of said locking element engages at least one of the detent elements of said at least one row of detent elements such that said counter-detent element is not movable in the longitudinal direction across said detent elements, said locking element also having an open position in which no counter-detent element of said locking element engages any detent element of said at least one row of detent elements such that;

at times when the locking element is in said closed position, the second tubular-shaped hollow body is not moveable in a longitudinal direction with respect to the first tubular-shaped hollow body; and at times when the locking element is in said open position, the second tubular-shaped hollow body is moveable in a direction longitudinally into the first tubular-shaped hollow body and is also moveable in a direction longitudinally out of the first tubular-shaped hollow body.

27. The variable length packing container of claim 26 wherein said locking element engages said first tubular-shaped hollow body by closing against the outer surface of said first tubular-shaped hollow body, said locking element having a fastener for selectively opening and closing said locking element, said locking element being movable away from the outer surface of said first tubular-shaped hollow body at times when said fastener is in the open position to disengage the counter-detent of the locking element from the detent elements of said at least one row of determent elements.

28. The variable length packing container of claim 27 wherein the fastener of the locking element is selected from the group comprising a snap-lock fastener, a knee lever fastener, and a hook and loop fastener.

29. The variable length packing container of claim 27 wherein said locking element includes a casing and wherein said counter-detent of the locking element is a spring tab that is formed in said casing, said spring tab having a first side that is integral with said casing, said spring tab having a second side that is opposite from said first side and that is formed in a radial hook, said radial hook engaging the detent elements of said row of detent elements of said second tubular-shaped hollow body at times when the locking element is in the closed position.

30. The variable length packing container of claim 29 wherein the first and second tubular-shaped hollow bodies have a cross-section with four sides, said casing comprising four sections that are joined together in end-to-end relationship by three hinges, with each of said hinges being connected to the ends of two of said sections, the ends of two of said sections of said casing being connected to said fastener and selectively connected together by said fastener at times when said fastener is in the closed position.

31. The variable length packing container of claim 29 wherein the locking element has a detent structure and the first tubular-shaped hollow body has a counter-detent structure that is complementary to the detent structure of the locking element and that cooperates with the detent structure of the locking element to secure the locking element at a fixed longitudinal position on said first tubular-shaped hollow body.

32. The variable length packing container of claim 27 wherein the inner surface of said first tubular-shaped hollow body has radially inwardly extending projections at the corners of said inner surface to guide the second tubular-shaped hollow body in the longitudinal direction within said first tubular-shaped hollow body.

* * * * *